US007740570B2

(12) United States Patent
Winston

(10) Patent No.: US 7,740,570 B2
(45) Date of Patent: Jun. 22, 2010

(54) AQUATIC EXERCISE DEVICE

(76) Inventor: Edith Winston, 2110 Harbourside Dr., Longboat Key, FL (US) 34228

( * ) Notice: Subject to any disclaimer, the term of this patent is extended or adjusted under 35 U.S.C. 154(b) by 441 days.

(21) Appl. No.: 11/367,717

(22) Filed: Mar. 6, 2006

(65) Prior Publication Data

US 2007/0207905 A1 Sep. 6, 2007

(51) Int. Cl.
*A63B 21/02* (2006.01)

(52) U.S. Cl. ..... 482/121; 482/55

(58) Field of Classification Search ..... 482/121–130, 482/55, 111, 81

See application file for complete search history.

(56) References Cited

U.S. PATENT DOCUMENTS

| | | | | | |
|---|---|---|---|---|---|
| 163,957 | A | | 6/1875 | Wood | |
| 512,483 | A | | 1/1894 | Patterson | |
| 2,719,038 | A | | 9/1955 | Massa | |
| 2,930,614 | A | | 3/1960 | McIntosh | |
| 3,460,829 | A | | 8/1969 | Roggero | |
| 3,655,185 | A | | 4/1972 | Kane | |
| 4,079,932 | A | | 3/1978 | Schuetz | |
| 4,090,705 | A | * | 5/1978 | Young | 482/82 |
| 4,673,179 | A | | 6/1987 | Pengler | |
| 4,685,671 | A | | 8/1987 | Hagerman et al. | |
| 4,722,523 | A | | 2/1988 | Yang | |
| 4,779,867 | A | | 10/1988 | Hinds | |
| 4,787,624 | A | * | 11/1988 | Grant | 482/82 |
| 4,789,154 | A | * | 12/1988 | Mattox | 482/10 |
| 4,801,137 | A | | 1/1989 | Douglass | |
| 4,852,873 | A | * | 8/1989 | O'Donnell et al. | 482/126 |
| 4,934,691 | A | * | 6/1990 | Rudd | 482/82 |
| 5,033,740 | A | | 7/1991 | Schwartz et al. | |
| 5,052,365 | A | | 10/1991 | Carella | |
| 5,131,650 | A | | 7/1992 | Hall | |
| 5,230,679 | A | * | 7/1993 | Olsen | 482/91 |
| 5,244,444 | A | | 9/1993 | Wostry | |
| 5,277,169 | A | * | 1/1994 | Magnuson | 124/20.1 |
| 5,314,396 | A | | 5/1994 | Parr | |
| 5,336,151 | A | | 8/1994 | Van Ballegooie | |
| 5,372,565 | A | * | 12/1994 | Burdenko | 482/124 |
| 5,514,058 | A | | 5/1996 | Buoni et al. | |
| 5,549,532 | A | | 8/1996 | Kropp | |
| 5,569,137 | A | | 10/1996 | Uen | |
| 5,611,763 | A | * | 3/1997 | Lochbaum | 482/111 |
| 5,613,926 | A | | 3/1997 | Michaelson | |
| 5,620,397 | A | | 4/1997 | Chieh | |
| 5,637,066 | A | | 6/1997 | Chang | |
| 5,741,207 | A | | 4/1998 | Buoni et al. | |
| 6,244,998 | B1 | * | 6/2001 | Hinds | 482/126 |
| 6,692,415 | B1 | * | 2/2004 | Winston | 482/126 |
| 7,153,247 | B1 | * | 12/2006 | Filkoff | 482/121 |
| 7,306,501 | B2 | * | 12/2007 | Pierce et al. | 441/83 |
| 2002/0103059 | A1 | * | 8/2002 | Kushner | 482/126 |

* cited by examiner

*Primary Examiner*—Lori Baker
(74) *Attorney, Agent, or Firm*—Edell, Shapiro & Finnan, LLC

(57) ABSTRACT

An elastomeric band exercise device is modified by adding a cushion to the band to permit it to be comfortably stepped on with a bare foot without discomfort. The modification is particularly advantageous when the device is used in performing aquatic exercises. Each handle has a waterproof friction grip covering a steel weight bar. The handle is connected to the band by a retainer ball in the end of the band and a washer inserted between the ball and a throat in the handle through which the band is extended.

9 Claims, 4 Drawing Sheets

AQUATIC EXERCISE DEVICE

CROSS REFERENCE TO RELATED PATENT

The present invention is a modification and improvement of the exercise device disclosed in my U.S. Pat. No. 6,692,415 issued Feb. 17, 2004 and entitled "Exercise Device and Kit". The disclosure in that patent is incorporated herein in its entirety.

BACKGROUND OF THE INVENTION

1. Field of the Invention

The present invention relates to exercise devices and methods and, more particularly, to an improved exercise device of the type disclosed in my 6,692,415 patent and having particular advantages when used in swimming pools.

2. Description of the Related Art

The exercise device disclosed in my 6,692,415 patent includes a longitudinally resilient elastomeric tube serving as a resistance exercise device. The tube is secured to and extends between two handles permitting the tube to be alternately stretched and relaxed by a person exercising with the device. The tube is removably engaged at each handle by extending the tube through a bore or channel, and inserting a retainer ball of greater diameter than the tube and bore into the diametrically stretched end of the tube. With the end of the tube stretched about the retainer ball, the retained ball prevents the tube from becoming loose and disengaged from the handle during use. The handle has a hollow cylindrical grip with a weighted cylindrical bar disposed therein to add to the muscle exercise value of the device. One valuable exercise routine with which the device can be used involves the person standing with one or both feet on the approximate center of the tube with the tube on the floor or ground to trap the tube in place. The person grasps the handles with respective hands and then moves the handles upward and/or outward to achieve different muscular exercises for the person's arms. The described device serves this and other exercise functions quite well.

With the increasing popularity of aquatic exercising, it is desirable that the described exercise device be used in a swimming pool. However, a barefoot person who steps on the elastomeric tube, trapping it between the sole of his/her foot and the bottom surface or floor of the pool, experiences considerable pain or discomfort. Specifically, much of the person's weight bears on the tube which presses up into a small linear portion of the ball or sole of the foot which, in most people, is relatively tender. Consequently, the force of much of the weight is concentrated on a small area resulting in a relatively large pressure. This limits the use of the device in aquatic exercising activities.

Another potential disadvantage of the device disclosed in my prior patent pertains to the fact that the retainer ball disposed in the stretched end of the band to retain the band in the handle is, in some instances, difficult to remove when replacing the band. Specifically, the base of the handle includes an opening through which the band extends, and the portion of the band extending into the interior space in the handle is stretched over the retainer ball. The band is then pulled distally until a portion of the ball extends into the handle opening. In some instances the ball is inserted so tightly into the opening as to make removal difficult without damaging the band.

OBJECTS AND SUMMARY OF THE INVENTION

Therefore, in light of the above, and for other reasons that become apparent when the invention is fully described, an object of the present invention is to render the device and method disclosed in my 6,692,415 patent comfortable and useful in aquatic exercise activities.

A further object of the present invention is to modify the device disclosed in my 6,692,415 patent for effective use in a swimming pool or similar environment.

A still further object of the present invention is to modify the connection between the band and handle of the device disclosed in my U.S. Pat. No. 6,692,414 so as to permit the band to be easily changed/replaced without sacrificing the connection during use of the device.

In accordance with the present invention, the device disclosed in my prior 6,692,415 patent is modified for comfortable and effective exercise use in a body of water such as a swimming pool. In particular, one aspect of the present invention involves providing a cushioned sleeve or other force distribution structure concentrically disposed along the outside of the elastomeric tube at or near the tube longitudinal center. The person using the device is able to stand with one or both feet on the sleeve which is able to absorb the person's weight, distributing that weight over a larger area of the sole, and thereby eliminates discomfort and pain. Instead of a sleeve, per se, any configuration of a cushion or force distribution element may be secured to the tube.

In addition, the grip portions of the handle structure are made of or covered with waterproof material, such as vinyl or other plastic material, which has a sufficiently high coefficient of friction to prevent the user's hand from slipping during exercising without sacrificing the waterproofing function. Specifically, slippage is a potential problem for a device of the type described when used in an aquatic environment, but the high friction cover obviates that problem.

Further, the connection between the band and handle utilizes a washer disposed over the end of the band to prevent the retainer ball from being drawn into and wedged in the hole in the handle that receives the elastomeric band. This modification retains the integrity of the connection while enabling the band to be removed from the handle when desired.

The aforesaid objects are achieved individually and in combination, and it is not intended that the present invention be construed as requiring two or more of the objects to be combined unless expressly required by the claims attached hereto.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1:
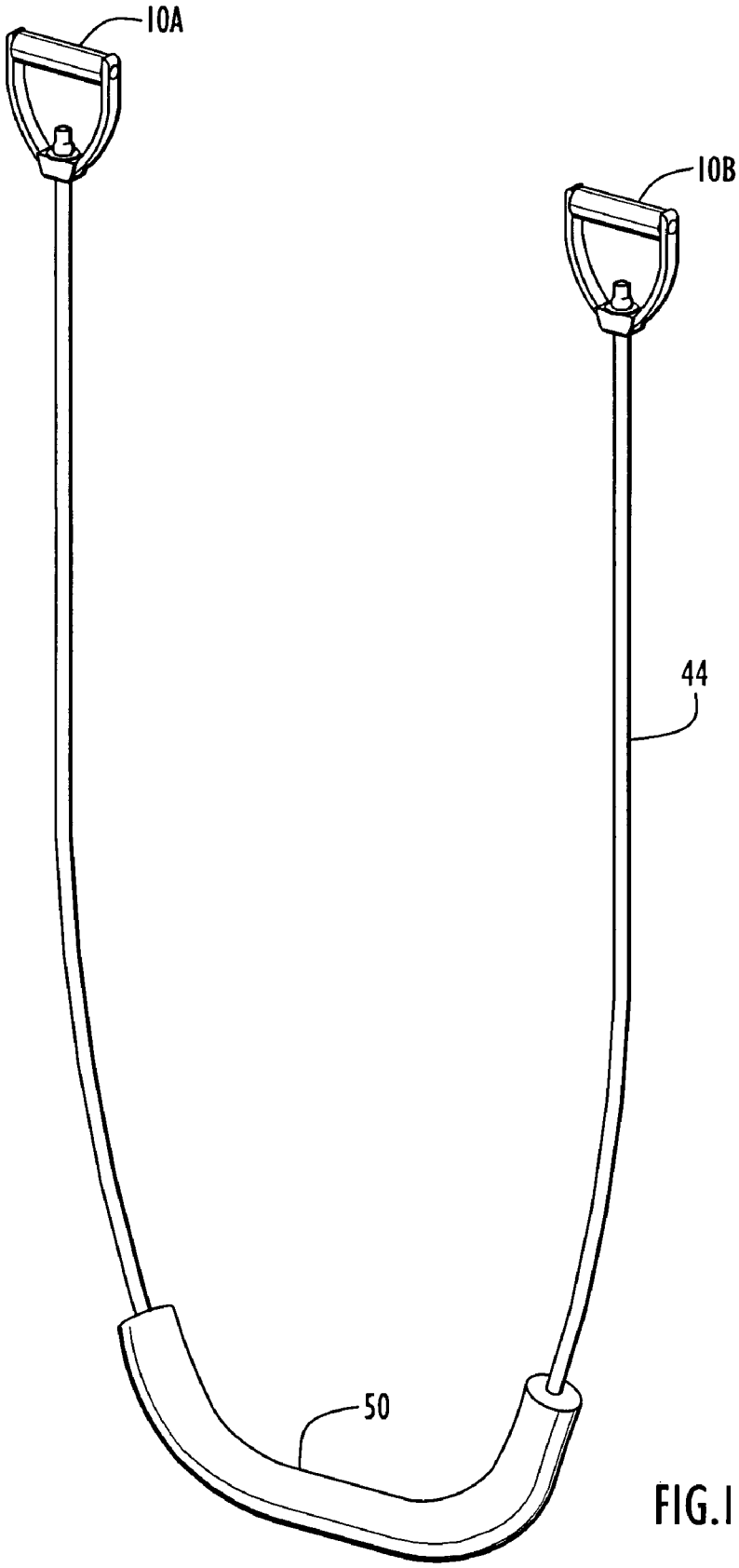
FIG. 1 is a view in perspective of the aquatic exercise device of the present invention.
Figure 4:
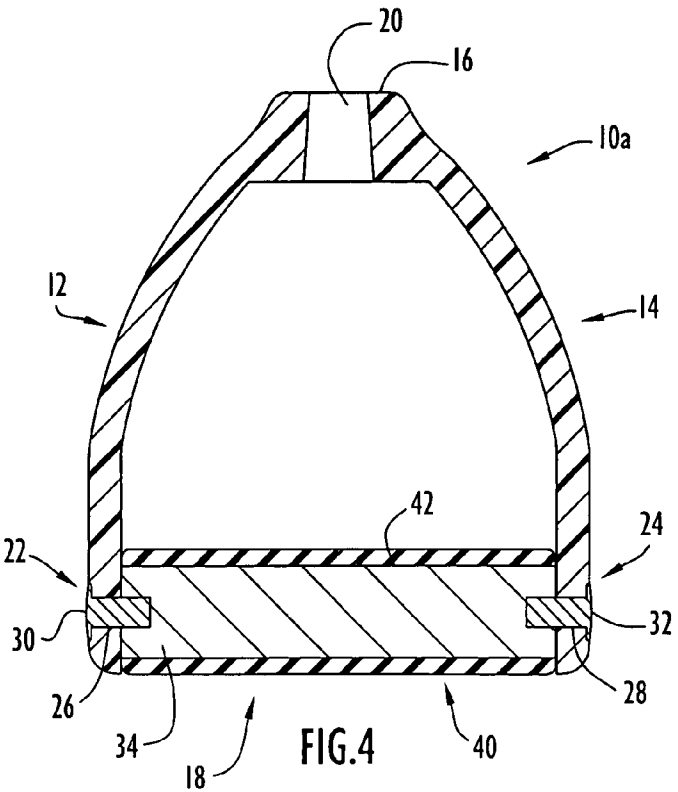
FIG. 4 is a view in section taken along lines 4-4 of FIG. 3.
Figure 3:
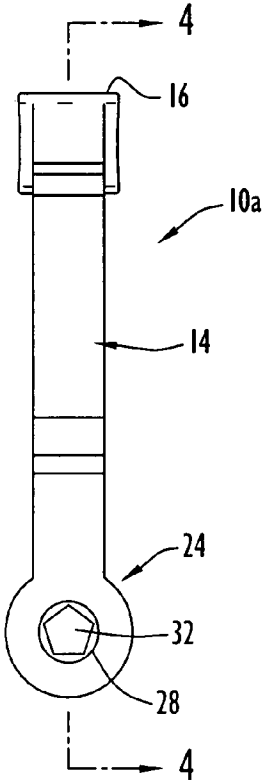
FIG. 3 is a side view in elevation of the handle of FIG. 2.
Figure 2:
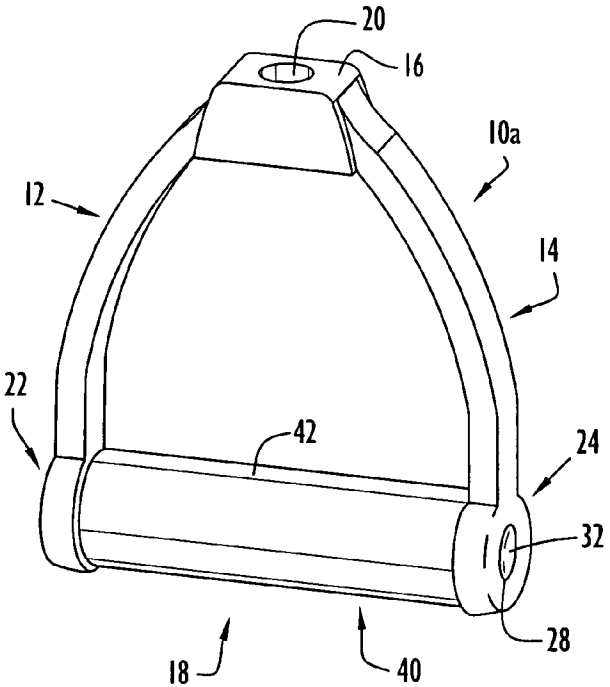
FIG. 2 is a view in perspective of a handle of the de device of FIG. 1.

The following detailed explanations of drawings and of the preferred embodiments reveal the methods and apparatus of the present invention.

Referring specifically to the accompanying drawings, the present invention pertains to an improved exercise device of the type utilizing elastomeric bands or tubes to provide resistance for exercising various muscles. The exercise device of the present invention comprises two handles interconnected by an elastomeric tube, whereby the tube is connected to each handle via a corresponding connecting structure. The exercise device is typically utilized by grasping the handles in a manner whereby the elastomeric tube is alternately stretched and released between the handles such that the tension created in the band exercises the muscles of a user. The handles and connecting structure enable the tube to be replaced by other tubes of various tensile resistances or strengths to adjust the resistance provided by the exercise device. An important aspect of the invention is the provision of a rubber or plastic foot cushion disposed about a portion of the tube to distribute the weight on the sole of the foot of the person using the device when standing with a bare foot on the tube.

An elastomeric band or tube 44 is secured at its ends to, and extends between, two handles 10*a* and 10*b*. A cushion 50 is disposed concentrically about the central portion of the length of tube 44. In the preferred embodiment, the cushion is in the form of a foam rubber cylindrical sleeve having an inside diameter that is equal to or slightly smaller than the outside diameter of the tube. In this manner, cushion 50 is made to closely adhere to the tube such that it does not inadvertently move along the tube during use, transport or storage. The length of cushion is sufficient to extend laterally across both feet of any person who might step on tube 44 with feet spaced apart when using the device. A preferred range of cushion lengths is eight to thirty inches, and a preferred standard length is twenty inches. The outside diameter or transverse dimension of the cushion is greater than the transverse dimension or diameter of tube 44 and sufficient to permit the weight of the user to be comfortably distributed along the ball or sole of the user's foot. A preferred range of outside diameters is one-half to four inches and a preferred standard outside diameter of the sleeve is one inch. Band 44 can have any length appropriate for the intended exercises. Typically, the band length is in the range of 40 inches to 72 inches, and is optimally between 50 and 60 inches.

Although the preferred sleeve material is foam rubber, it may also be resilient plastic or plastic foam that provides the desired cushioning effect without substantially degrading when immersed in chlorinated pool water. Likewise, although the cushion preferably is configured as a cylindrical sleeve, it may have any other configuration that enables it to provide the cushioning function; examples include a mat or block or any other configuration on which the person using the exercise device can comfortable stand with one foot or two.

For purposes of this aspect of the invention (i.e., the cushioned elastomeric band), the band may be a tube or a non-tubular elongate piece of elastomeric material. The band should be longitudinally resiliently stretchable to provide resistance during exercises involving band elongation.

Handle 10*a* is generally stirrup-shaped (i.e., generally U-shaped) and includes arms 12, 14, a base 16 and a grip 18. Arm 12 is preferably of rectangular transverse cross-section and constructed of high impact plastic or metal. The arm includes a tapered distal end and a grip interface 22 disposed at the arm proximal end. A slight inward bend is formed in arm 12 distally of grip interface 22, whereafter the arm curves inwardly from the bend toward the handle interior. Grip interface 22 is generally annular having a substantially central recessed opening or hole 26 defined therein. The opening is recessed within arm 12 to accommodate a fastener 30 for securing grip 18 to the handle as described below.

Arm 14 is substantially a mirror image of arm 12 and includes a tapered distal end and a grip interface 24 disposed at its proximal end, and a slight bend is formed distally of grip interface 24, whereafter the arm curves inwardly from the bend toward the handle interior. Grip interface 24 is substantially similar to grip interface 22 and includes a generally annular configuration with a substantially central recessed opening 28 defined therein for accommodating a fastener 32 to secure grip 18 to the handle as described above.

Arms 12, 14 are positioned in facing relation with grip interfaces 22, 24 substantially aligned. The arms curve inwardly from their respective bends toward the handle interior with the tapered distal ends of the arms joined to base 16. Base 16 generally serves as a handle neck and is in the form of a generally trapezoidal block. The base includes a substantially central frusto-conical throat or channel 20 defined therein having a larger diameter at the throat proximal end (e.g., the throat end facing interiorly of the U-shaped handle). The throat receives one end of elastomeric band 44 to facilitate removable connection of the band to the handle as described below. The channel 20 need not be frusto-conical and instead may be cylindrical.

Grip 18 is secured to and extends between grip interfaces 22, 24. The grip includes a generally cylindrical weight bar 34 and a friction grip cover 40 that is disposed concentrically over and encloses the bar. Bar 34 is typically a one pound steel or other metal weight but may be heavier (e.g., 1.5 lbs., 2.0 lbs.) or heavier). Cover 40 is a cylindrical tube made of high friction vinyl or similar plastic or other material that protects bar 34 against rust while serving as an outer friction surface 42 to permit the bar to be grasped when wet in the user's hand without slipping. The cover may be secured to bar 34 by a suitable adhesive to prevent mutual rotation of the cover about the bar. In the preferred embodiment the cover 40 has a bright yellow or orange cover to render it both attractive and immediately visible in a pool environment. The weight bar (typically one pound) has tapped holes (not shown) recessed centrally and axially of its opposite ends. The tapped holes are aligned with corresponding recessed grip interface openings 26, 28 to permit screws 30, 32 to be inserted through the respective openings and tapped holes to secure the grip to the handle. Screws 30, 32 and their mating threaded receptacles are made of steel or other non-rusting material. The grip interface openings are recessed to essentially form respective notches within the arms for enabling heads of screws 30, 32 to be substantially flush with the exterior surfaces of the arms when securing the grip to the handle.

By way of example only: handle 10*a* may have a length (e.g., the distance from the throat distal end to the proximal ends of the arms) of approximately fifteen centimeters and a proximal width dimension (e.g., the distance between the exterior surfaces of the arms at their proximal ends) of approximately fourteen centimeters; base 16 may have a proximal width dimension (e.g., the distance along the base proximal end between the tapered distal ends of the arms) of approximately 4.4 centimeters, a distal width dimension (e.g., the distance along the base distal end between the tapered distal ends of the arms) of approximately 3.5 centimeters, and a length (e.g., the distance between the base proximal and distal ends) of approximately 2.6 centimeters and a depth of approximately 2.7 centimeters; the throat may have a proximal end diameter of approximately two centimeters and a distal end diameter of approximately 1.5 centimeters; and the grip may have a length (e.g., the distance along a longitudinal axis of the grip) of approximately twelve centimeters with an approximate cross-sectional diameter of 3.4 centimeters (e.g., the diameter of grip 18 with covering 40, whereby the cross-sectional diameter of individual grip bar 34 without the covering is approximately 2.5 centimeters). However, the handle, base and grip (e.g., including the grip bar) may be of any size or shape, and may be constructed of any suitable materials, consistent with the functions attributed thereto herein.

The resistance provided by the exercise device may be adjusted by interchanging bands of various tensile strengths. The relative tensile strength of a band constructed of a particular material is generally related to the band diameter, whereby the greater the band diameter, the greater the resistance provided by that band relative to other bands of the same material. The bands may be constructed of rubber, latex, steel (e.g., the band may be implemented by a cable), woven steel, rope or other suitable materials, and are removably connected to the handle to facilitate band interchange. This interchange feature enables the handles to provide protection for a user allergic to latex or other types of bands, since the user may interchange that band with another band compatible with the user.

Figure 5:
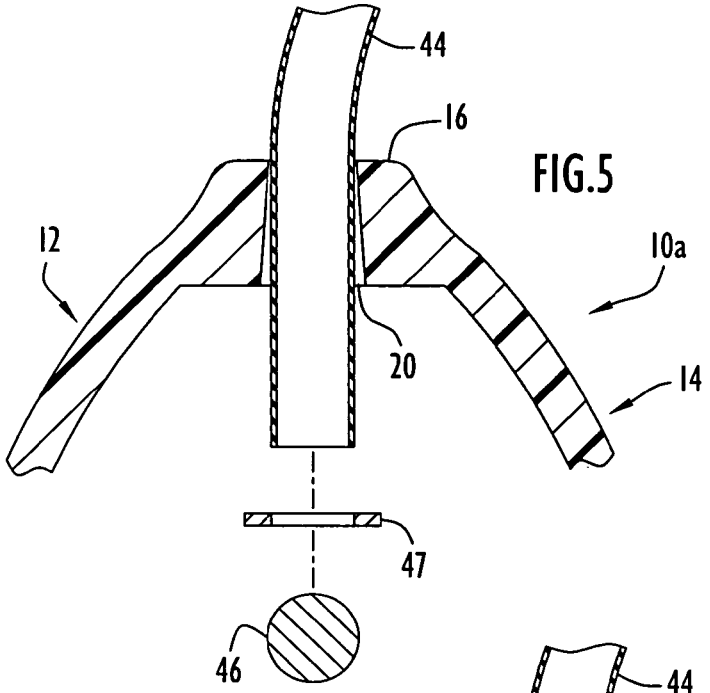
FIG. 5 is an exploded view in section of a portion of the handle of FIG. 2, illustrating assembly of the handle to the elastomeric tube illustrated in FIG. 1.
Figure 6:
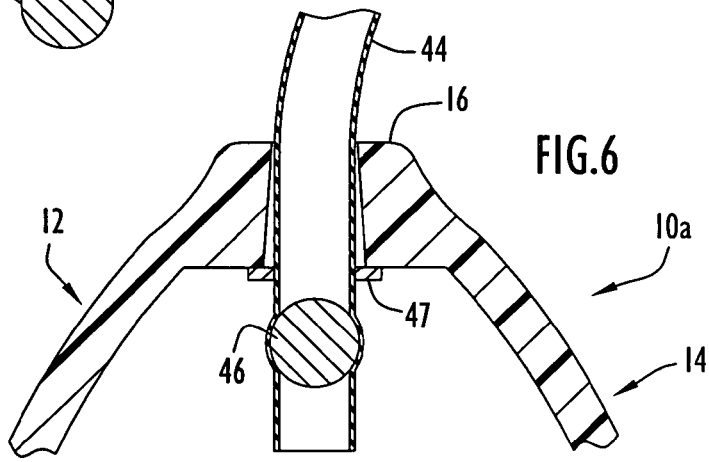
FIG. 6 is a view in section showing the handle and tube of FIG. 5 partially assembled.
Figure 7:
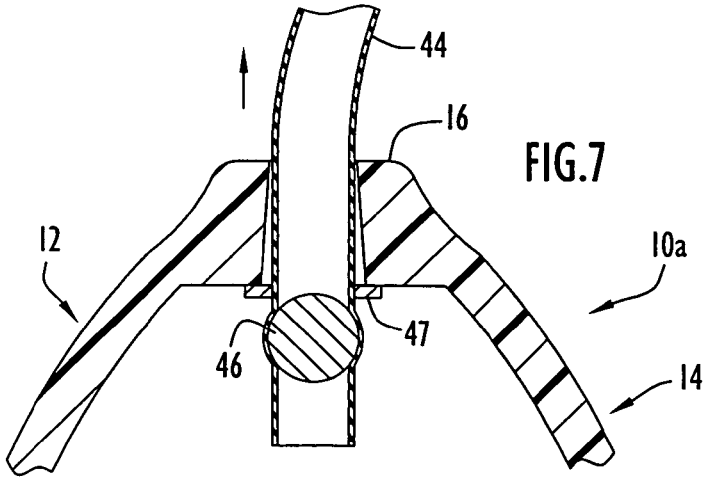
FIG. 7 is a view in section showing the handle and tube of FIG. 5 fully assembled.
Figure 8:
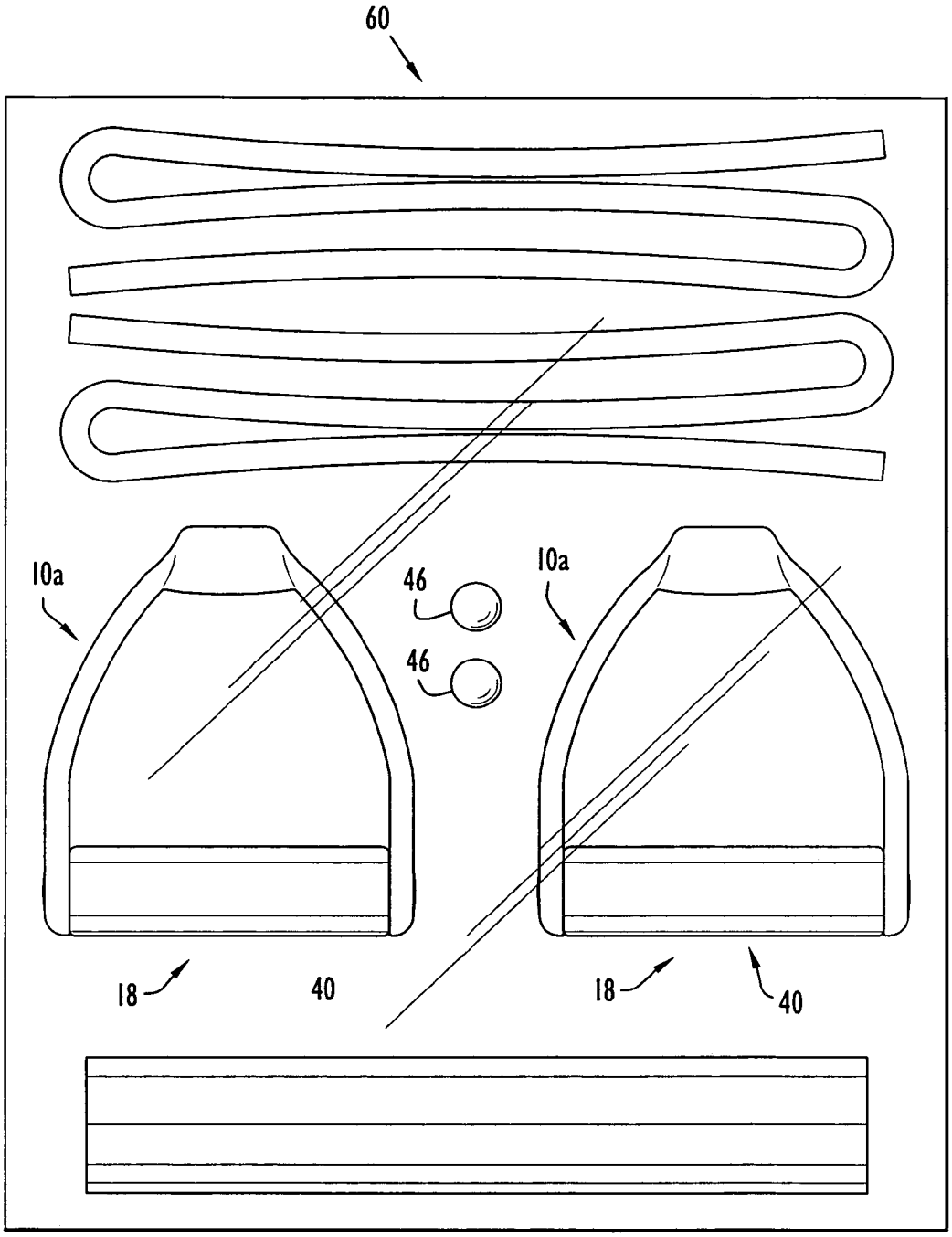
FIG. 8 is a view in plan of a packaged kit containing the aquatic execise device of the present invention.

A manner of removably connecting a band to handle 10*a* is illustrated in FIGS. 5-7. Specifically, one end of band 44 is inserted proximally through throat 20 and extends slightly into the enclosed space interiorly of the handle structure. Band 44 is preferably implemented by an elastomeric tube having a diameter slightly less than the individual diameters of the proximal and distal ends of throat 20. An annular washer 47, either metal or plastic, has an inner diameter that is preferably smaller than the diameter of the proximal end of throat 20 and approximately equal to or slightly smaller than the outer diameter of tube 44. Washer 47 is placed over the end of tube 44 that extends into the interior space of the handle and then slid longitudinally along the tube until the washer abuts handle base 16. The band end extending beyond the washer and into the handle interior space is then diametrically stretched to receive a solid retainer ball 46 having a diameter greater than the inner diameter of washer 47. The retainer ball is typically positioned within the band a slight distance from the band receiving end, whereby the surrounding band portion stretches about the ball to secure the ball within the band. The band is subsequently pulled distally to position retainer ball 46 and the surrounding stretched band portion in abutting relation with the washer. Band 44 is thus secured firmly in place without extending into throat 20 where it could be difficult to retrieve in the event that the band is to be disassembled from the handle. The physical dimensions of the washer thus prevent the retainer ball and stretched tube portion from extending into throat 20. The retainer ball compresses the surrounding band walls against the washer with a force that increases as the band tension increases (e.g., as the band is pulled distally or forced distally through the washer as a result of band tension created during use of the exercise device). The retainer ball thus prevents the band from becoming loose or becoming disengaged from the handle, particularly during use.

Band 44 may be removed from the handle and replaced with bands of different tensile strengths to alter the resistance of the exercise device. In particular, band 44 is pushed proximally through throat 20 until the stretched band portion containing retainer ball 46 is free of the washer 47. The retainer ball is removed from the stretched band portion and the band is subsequently withdrawn from the throat. A new band having a different tensile strength may be inserted proximally through throat 20 with an end extending slightly beyond the throat proximal end into the handle interior space. The washer is placed over the end of the new band, and the new band end is diametrically stretched for insertion of retainer ball 46 into the band. The new band is pulled distally through throat 20 to position the stretched band portion containing retainer ball 46 against the washer. The retainer ball secures the new band to the handle as described above.

Having described preferred embodiments of new and improved Aquatic Exercise Device, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. An exercise device for use in a swimming pool containing liquid comprising:

an elastomeric band resiliently stretchable in longitudinal tension having first and second ends;

first and second handles attached to said first and second ends, respectively, and adapted to be gripped by respective hands of a person stepping on the band at a location intermediate said first and second ends in the swimming pool; and a cushion secured to the band at said location intermediate said first and second ends, said cushion comprising a material and a configuration for providing a cushioning effect for a foot of said person in response to the cushion being stepped upon and urged against the bottom of the swimming pool by the weight of the person, said material providing said cushioning effect without degrading when immersed in chlorinated pool water;

wherein each of said first and second handles includes a cylindrical hand grip having a waterproof cover having a high coefficient of friction to prevent said grip from slipping in a user's hand when the device is in use and the grip is wet;

wherein each handle includes:

a base having a throat defined therein for receiving said band end, wherein the smallest transverse cross-section of the throat is large enough to receive said band;

a plurality of arms, each arm having a distal portion joined to said base;

wherein said grip extends between said arms for facilitating manipulation of said handle by said user; and a ball resiliently inserted within said band end to expand said band; and a washer disposed about said band near said band end between said ball and said base, said washer having an inside diameter smaller than the throat at said base;

wherein said washer abuts both said base and the ball-expanded part of said band end to prevent the ball-expanded part of the tube end from entering said throat.

2. A method of using an exercise device in an aquatic environment containing liquid and having a bottom, said exercise device having a resilient longitudinally stretchable elastomeric band extending between two handle members and adapted to be stepped on by a first contact area of the sole of the user's foot to forcibly urge the band by the user's weight against said environment bottom, said method comprising the steps of:

a user of the band stepping on the band near its lengthwise middle portion against said aquatic environment bottom and alternately pulling on the handles to stretch the band in tension and releasing that tension, wherein a force is applied by the weight of the user on said middle portion against said bottom; and distributing said force over a distributed area, larger than said first contact area, of the sole of the user's foot, said step of distributing including cushioning at least the middle portion of the band with a cushioning member transversely larger than the band at said lengthwise middle portion.

3. The method of claim 2 wherein the step of distributing includes providing said cushioning member as a generally cylindrical sleeve of cushioning material concentrically about said middle portion of said tube.

4. The method of claim 3 wherein the step of cushioning further comprises providing said sleeve with a length dimension that is shorter than the length of the band and disposing said sleeve centered with respect to the length of the band.

5. The method of claim 2 further comprising the step of providing each of said first and second handle members with a cylindrical hand grip having a waterproof cover with a high coefficient of friction to prevent said grip from slipping in a user's hand when the device is in use and the grip is wet.

6. The method of claim 5 wherein said step of providing each of said first and second members with a hand grip includes providing said grip as a weighted bar weighing at least one pound.

7. An exercise device for use in a swimming pool containing liquid and having a floor, said exercise device comprising:

an elastomeric band resiliently stretchable in longitudinal tension and having first and second ends and a transverse dimension;

first and second handles attached to said first and second ends, respectively, and adapted to be gripped and alternately pulled and released by respective hands of a person stepping on and urging the band against said floor at a band intermediate location between said first and second ends, whereby a force is applied by the weight of the person on said band against said floor; and means for distributing said force over a transverse portion of the sole of the user's foot larger than the transverse dimension of the band.

8. The device of claim 7 wherein said means comprises a cushion secured to the band at said intermediate location, said cushion comprising a material and a configuration for providing a cushioning effect at said portion of the sole of said person when the cushion is stepped upon at, and urged against, the bottom of the swimming pool by the person, wherein said material provides said cushioning effect without degrading when immersed in chlorinated pool water.

9. In an exercise device having a resilient longitudinally stretchable elastomeric band extending between two handle members and used, in an aquatic environment having a bottom and containing liquid, by a user stepping on a middle portion of the band with a first contact area of the sole of the user's foot to forcibly urge the band by the user's weight against said environment bottom and then pulling on and releasing the handles to alternately stretch the band in tension and release that tension, an improvement for enhancing the comfort of the user of the device comprising:

means for distributing the user's weight over an area larger than said first contact area of the sole of the user's foot, said means comprising a cushioning member transversely larger than said band and secured to and disposed about said middle portion of said band to engage the sole of the user's foot and said bottom of said environment during use of the device.

* * * * *